US005309571A

United States Patent [19]

Huang

[11] Patent Number: 5,309,571

[45] Date of Patent: May 10, 1994

[54] FIRE-PROTECTING SUIT

[76] Inventor: Ming-Chi Huang, 11F., No. 440, Kuang Fu S. Rd., Taipei, Taiwan

[21] Appl. No.: 929,954

[22] Filed: Aug. 17, 1992

[51] Int. Cl.[5] ..... A41D 13/00

[52] U.S. Cl. ..... 2/81; 2/2; 2/84; 2/94

[58] Field of Search ..... 2/2, 2.1 A, 2.1 R, 69, 2/70, 81, 84, 85, 93, 94; 405/186, 187; 600/20

[56] References Cited

U.S. PATENT DOCUMENTS

| | | | |
|---|---|---|---|
| 2,420,362 | 5/1947 | Ekleberry | 2/2.1 R |
| 4,602,385 | 7/1986 | Warren | 2/2 |
| 4,864,654 | 9/1989 | Schriver | 2/69 |
| 5,119,510 | 6/1992 | Schilling | 2/84 |
| 5,211,321 | 5/1993 | Rodriquez | 2/94 |

FOREIGN PATENT DOCUMENTS

| | | | |
|---|---|---|---|
| 2715241 | 8/1978 | Fed. Rep. of Germany | 2/84 |

*Primary Examiner*—Clifford D. Crowder
*Assistant Examiner*—Diana L. Biefeld
*Attorney, Agent, or Firm*—Jacobson, Price, Holman & Stern

[57] ABSTRACT

A fire-protecting suit includes a fire protective clothing having a face mask for covering the head and a front pocket for keeping precious articles, a fire-proof eye shield, a mouthpiece and a cap-lamp respectively fastened to the face mask by elastic bands which, in turn, are sewn to the fire protective clothing, and an air tank (or a gas filter) and a battery power supply received inside the protective clothing and respectively connected to the mouthpiece and the cap-lamp by an air hose and an electric wire inside the protective clothing. The fire-protecting suit is folded up inside out when not in use. To use the suit, the face mask is put on the head to let the protective clothing be extended downwardly to cover the body. When the fire-protecting suit is in use, the air tank and the battery power supply are turned on, and then the hands are inserted through the sleeves of the protective clothing and extended out for saving things and performing a fire-fighting task.

6 Claims, 6 Drawing Sheets

FIRE-PROTECTING SUIT

BACKGROUND OF THE INVENTION

The present invention relates to a fire-protecting suit which comprises a fire-proof eye shield, an air tank mouthpiece (or gas filter mouthpiece) and a cap-lamp directly fastened to the face mask of the fire-protective clothing thereof, and which can be quickly dressed in within a very short time.

The protective clothing for a fire-fighter is generally made of asbestos or metallic fabric which is simply a protective covering. Therefore, a mask and an air tank shall be separately prepared. The air tanks which are commonly used by fire-fighters are heavy and not suitable for home use. It has been known that most victims of fire disasters die because of thick smoke. If any person in the scene of a fire can be equipped with a protective apparatus within a short time, one's life and many precious articles may be saved.

SUMMARY OF THE INVENTION

The present invention has been accomplished with the aforesaid circumstances in mind. According to the present invention, a fire-protecting suit is generally comprised of a protective clothing, a fire-proof eye shield, a mouthpiece and a cap-lamp, an air tank (or a gas filter and a battery power supply. The fire-proof eye shield and the cap-lamp are directly fastened to the face mask of the protective clothing. The mouthpiece is directly sewn on the face mask on the inside. The air tank and the battery power supply are received inside the protective clothing. A pocket is made on the front side of the protective clothing for saving precious articles. When not in use, the fire-protecting suit is folded up inside out. When in use, the face mask is put on the head to let the protective clothing fall down and cover the body. Once the hands are respectively inserted through the sleeves of the protective clothing and extended to the outside, the fire-protecting suit is dressed in, and therefore one is well-equipped to perform the task of a fire-fighter. Any important documents or precious articles taken from the scene of a fire can be saved in the front pocket of the protective clothing. Because the mouthpiece and other accessories are received inside the protective clothing, the user is permitted to get closer to or pass through the scene of a fire to fight the fire or rescue the people in the scene of the fire.

DETAILED DESCRIPTION OF THE PREFERRED EMBODIMENTS

Figure 1:
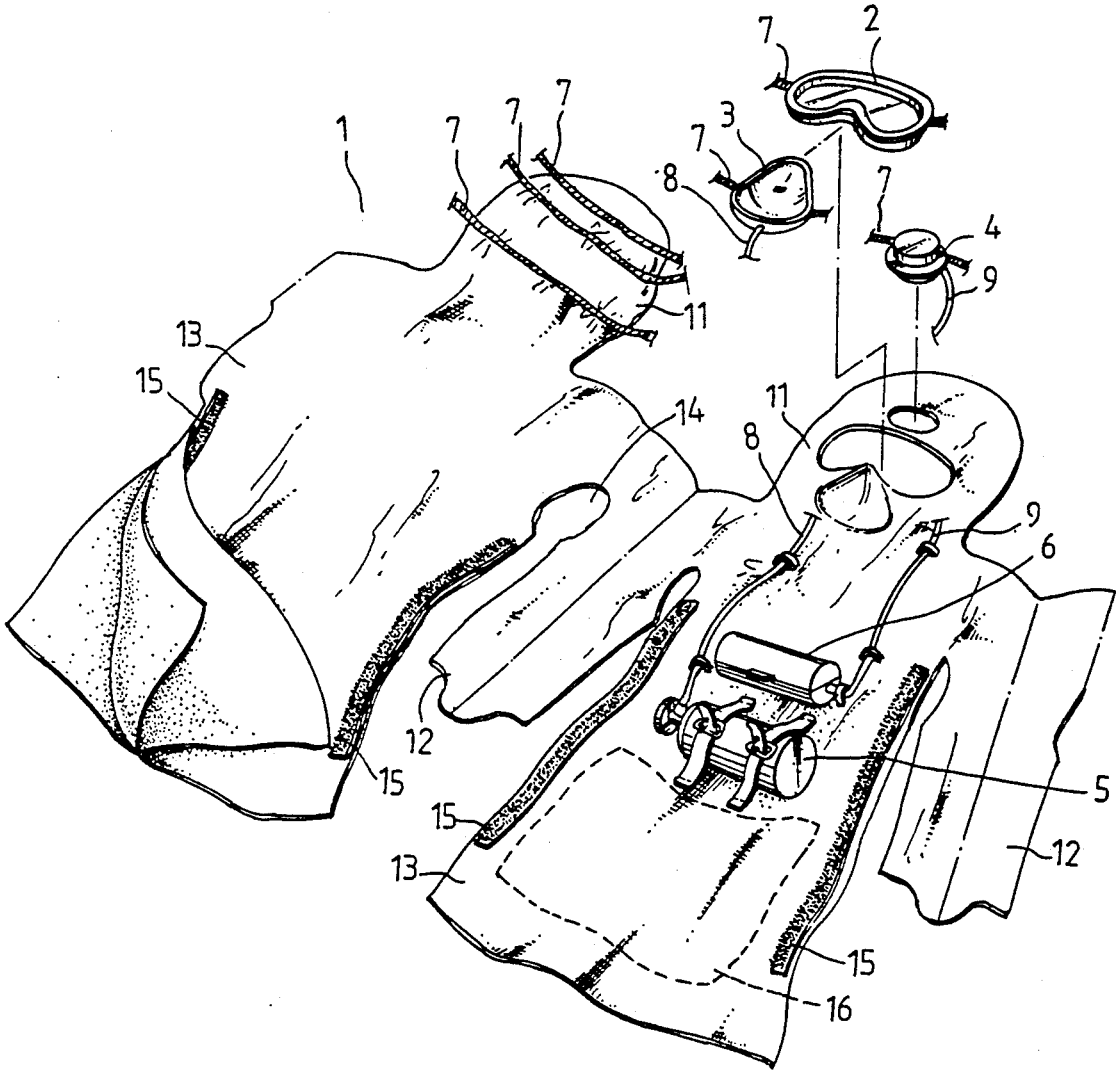
FIG. 1 is a spread-out view of the preferred embodiment of the fire-protecting suit of the present invention.

Referring to FIG. 1, a fire-protecting suit as constructed in accordance with the present invention is generally comprised of a protective clothing 1, a fire-proof eye shield 2, a mouthpiece 3, a cap-lamp 4, an air tank 5, and a battery power supply 6. The fire-proof eye shield 2 and the cap-lamp 4 are directly fastened to the face mask 11 of the protective clothing 1 by elastic bands 7 which are sewn to the face mask 11. The mouthpiece 3 is also directly sewn to the face mask 11 on the inside by another elastic band 7. The air tank 5 and the battery power supply 6 are received inside the protective clothing 1 and connected to the mouthpiece 3 and the cap-lamp 4 by an air hose 8 and an electric wire 9 respectively. The air hose 8 and the electric wire 9 are properly arranged inside the protective clothing 1 so that the protective clothing 1 can be conveniently put on the body.

Figure 2:
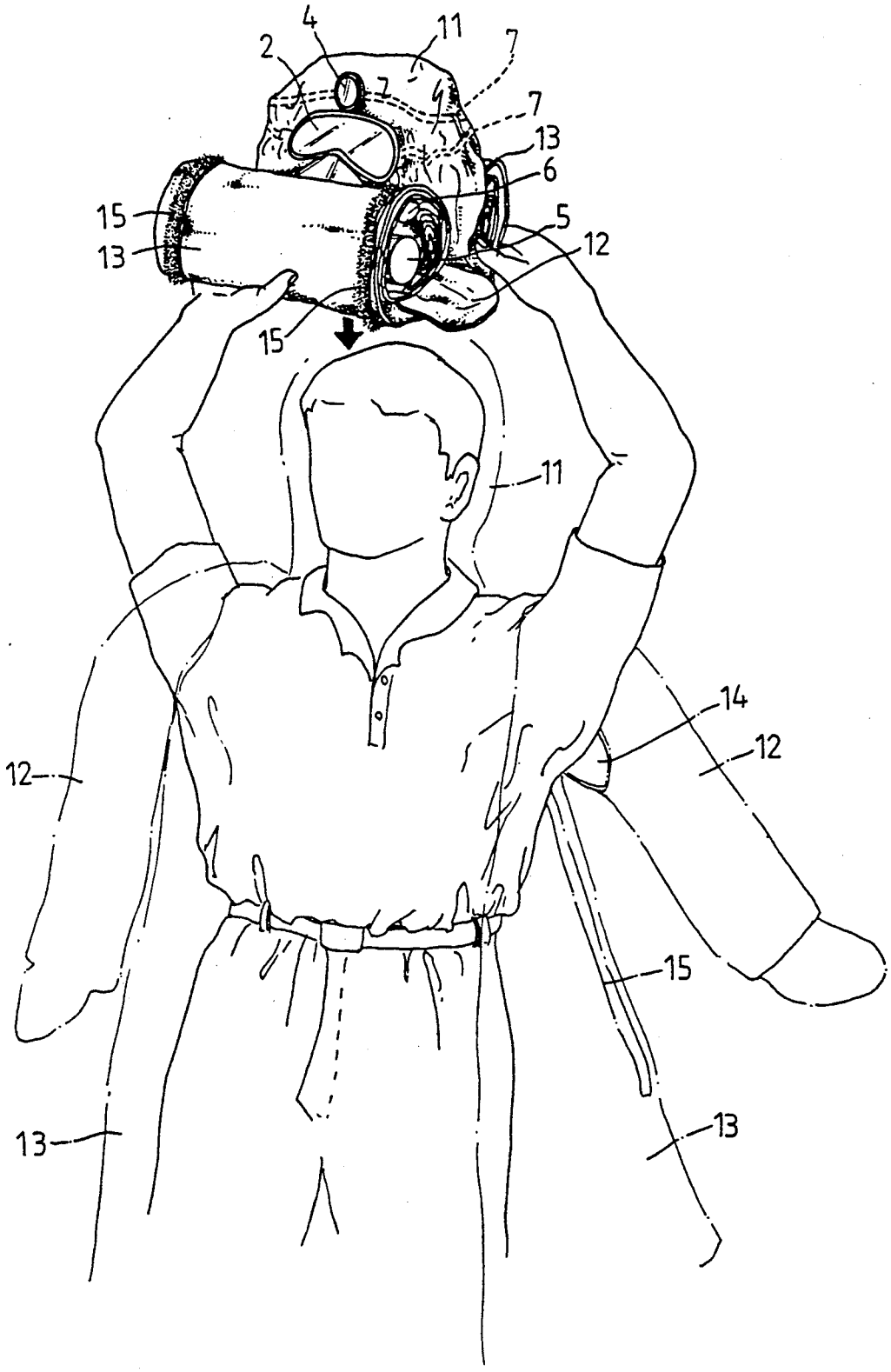
FIG. 2 is a pictorial drawing showing that the fire-protecting suit can be conveniently folded up.
Figure 3:
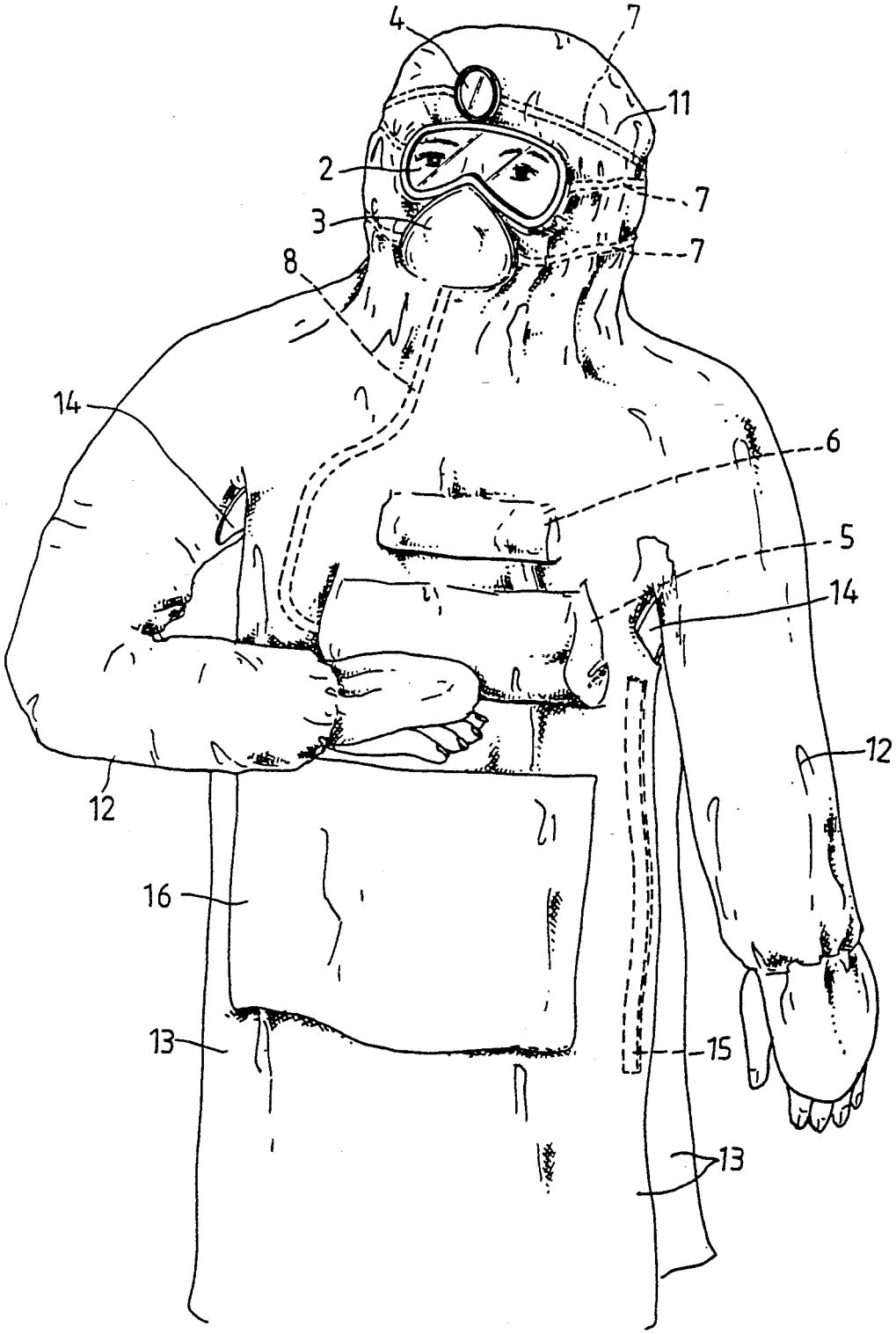
FIG. 3 illustrates the fire-protecting suit that has been put on the body.

Referring to FIGS. 2 and 3, the protective clothing 1 is formed of a front part and a back part connected at the shoulder areas, and each part comprises an outer layer of asbestos or of metallic fabric which resists the heat of a fire as high as 900° C., and two linings of heat isolating fabrics. The bodies 13 of the front and back part are releasably connected by fastener tapes 15 which include loop tapes and hook tapes. The front part of the protective clothing 1 has a pocket 16 on the front for keeping things. Openings 14 are formed between the sleeves 12 and the bodies 13, namely, on the two armpit areas so that the protective clothing 1 can be dressed in easily.

When not in use, the bodies 13 of the front and back parts of the protective clothing 1 are respectively turned inside out and folded up to expose the bottom opening of the face mask 11 to the outside. When in use, the bottom opening of the face mask 11 is directly put on the head to let the bodies 13 of the front and back parts be extended downwardly. The hands are respectively inserted through the sleeves 12, and the air tank 5 is opened, and then the fastener tapes 15 are respectively fastened up (see FIG. 3). These procedures can be done within 5 seconds. Therefore, a fire-fighter is well-equipped within a very short time to participate in a fire-fighting task. During a fire-fighting task, important documents and precious articles may be saved in the pocket 16.

Figure 4:
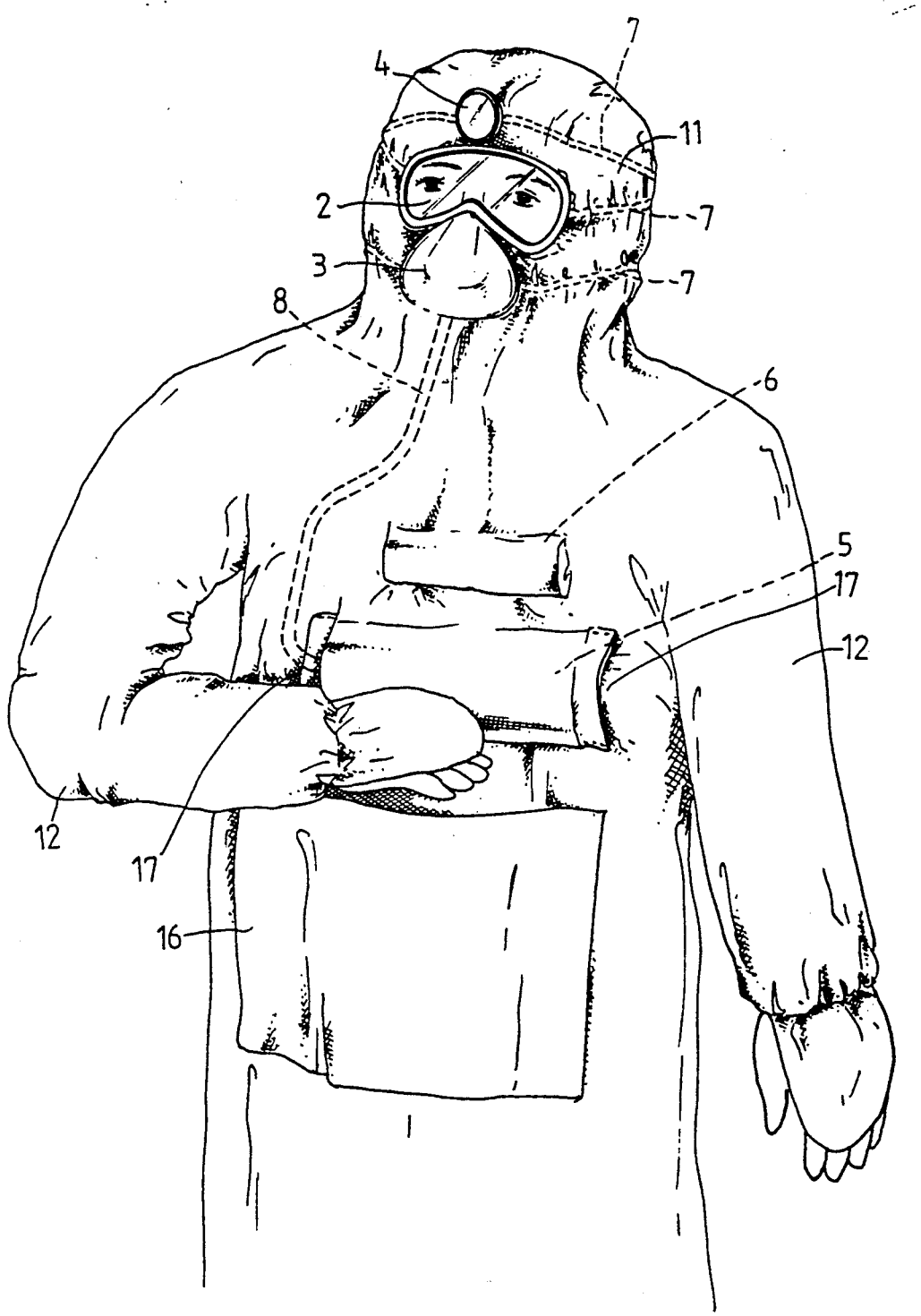
FIG. 4 illustrates an alternate form of the present invention.
Figure 5:
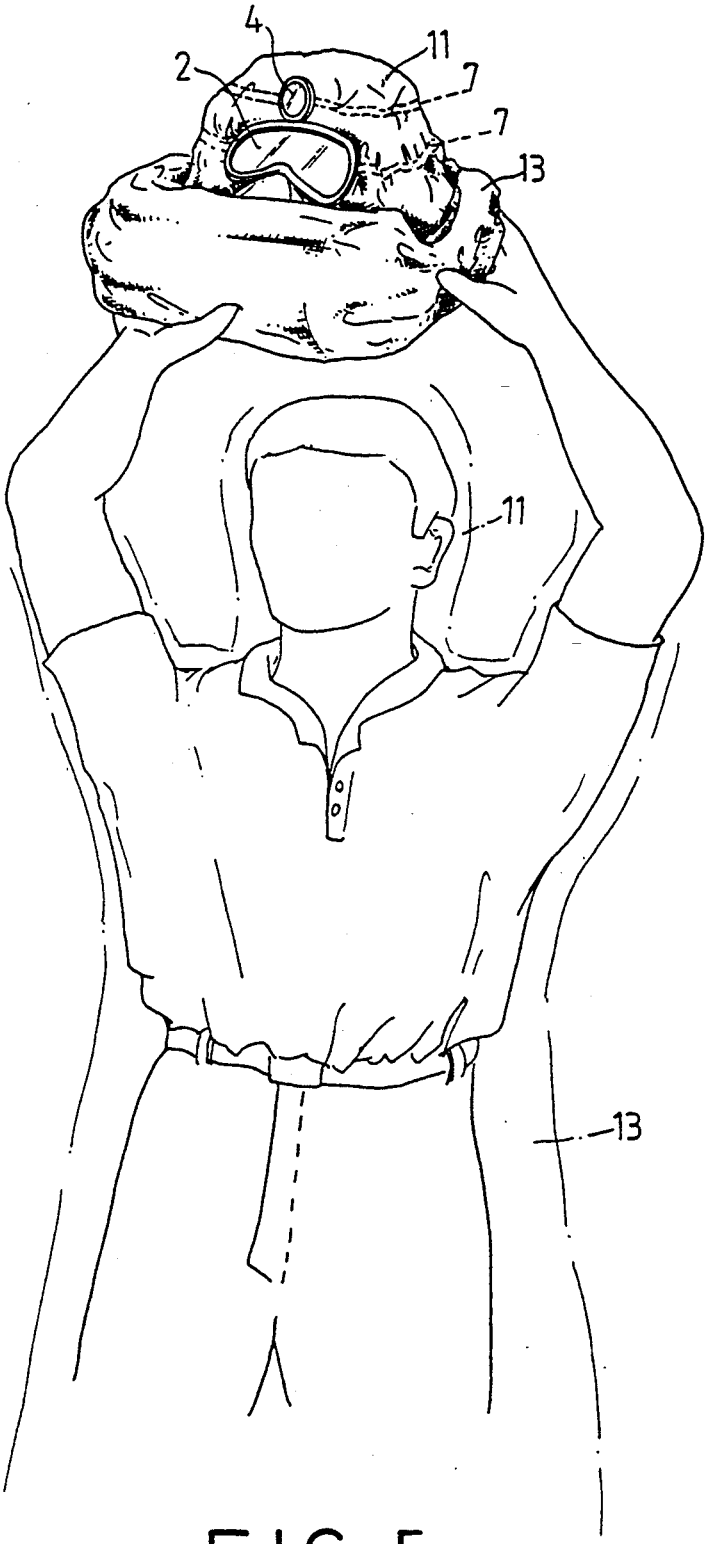
FIG. 5 illustrates the fire-protecting suit of FIG. 4 that has been folded up.

Referring to FIGS. 4 and 5, therein illustrated is an alternate form of the present invention. In this alternate form, the protective clothing 1 is formed in a single piece having a pocket 16 on the front for saving precious articles and two opposite openings 17 on the chest area. The openings 17 are formed of an outer flap of fire-proof fabric bridged over an inner flap of fire-proof fabric. When not in use, the protective clothing 1 is folded up inside out with the bottom opening of the face mask 11 exposed to the outside. When in use, the bottom opening of the face mask 11 is put on the head and the protective clothing 1 is paced down, and then the hands are respectively inserted through the sleeves 12 from the inside. After the protective clothing 1 has been put on the body, the hands may be inserted through the openings 17 to open the air tank 5 or the battery power supply 6.

Figure 6:
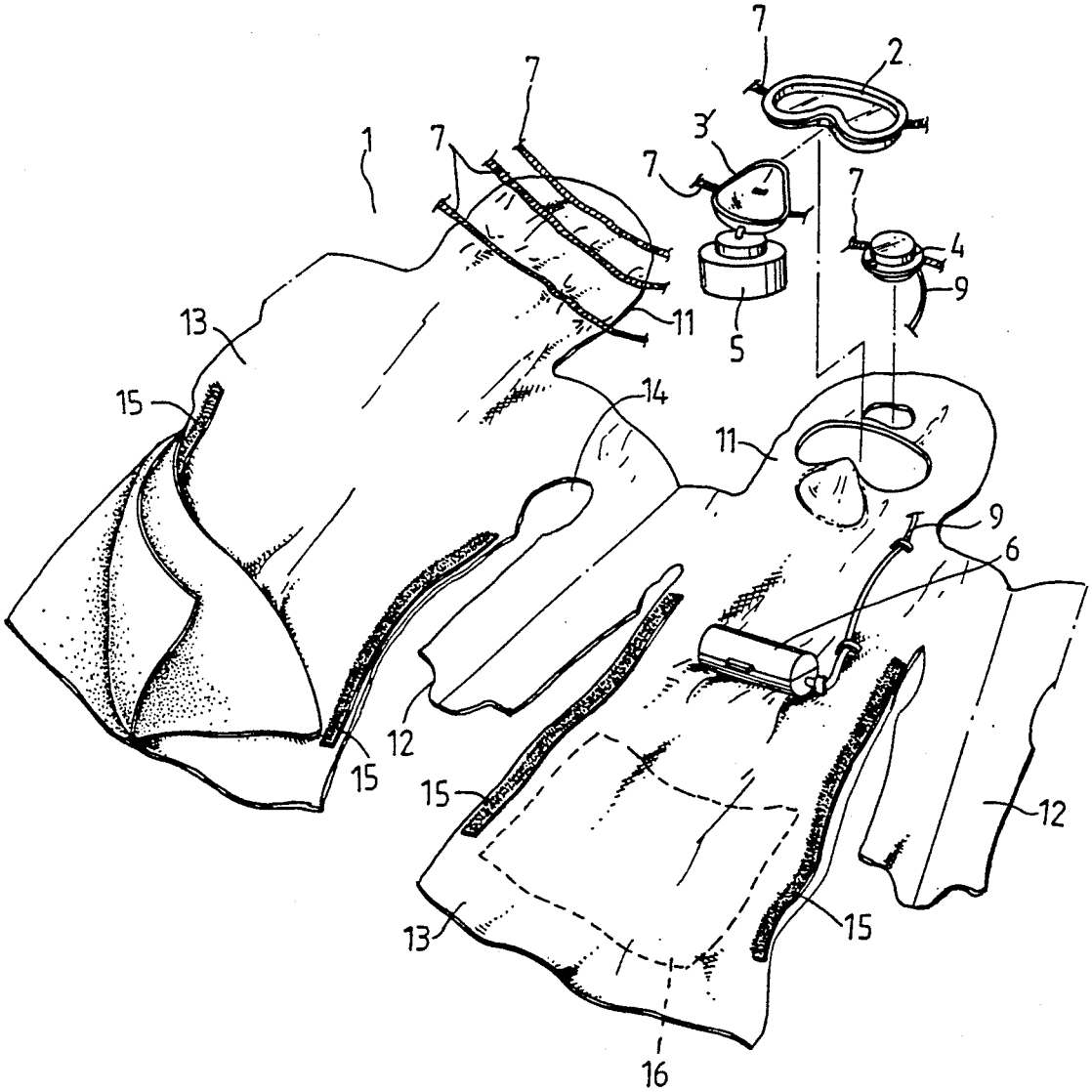
FIG. 6 illustrates the another alternate form of the present invention.

Referring to FIG. 6, therein it illustrates another alternate form of the present invention. In this embodiment, the fire-protecting suit also comprises a protective clothing 1, a fire-proof eye shield 2, a cap-lamp 4 and a battery power supply 6. However, a gas filter mouthpiece 3' and a gas filter 5' are used in this embodiment in place of the mouthpiece 3 and the air tank 5 of the aforesaid embodiments. Same as the aforesaid procedures, this embodiment of fire-protecting suit can be put on the body within 5 seconds, and therefore the user can start the fire-fighting task within a very short time.

As indicated, the present invention is to provide a fire-protecting suit which can be conveniently put on the body within a very short period of time. However, various modifications and changes could be made without departing from the scope of the invention and the invention is not considered limited to what is shown in the drawings and described in the specification.

What is claimed is:

1. A fire-protecting suit comprising a fire protective clothing, a fire-proof eye shield, a mouthpiece, a cap-lamp, an air tank, and a battery power supply, the fire-protective clothing comprising a face mask, wherein the fire-proof eye shield, the cap-lamp and the mouthpiece are directly fastened to the face mask by elastic bands, the air tank and the battery power supply being mounted to the inside of the fire-protective clothing and respectively connected to the mouthpiece and the cap-lamp by an air hose and an electric wire inside the fire-protective clothing so that the entire fire-protecting suit including the air tank can be donned rapidly.

2. The fire-protecting suit according to claim 1 wherein the fire-protective clothing is formed of a front part and a back part connected at the shoulder areas having openings on armpit areas thereof, the front part and the back part being releasably connected by loop tapes and hook tapes, the front part having a pocket on a front face thereof.

3. The fire-protecting suit according to claim 1, wherein the fire-protective clothing is made in a single piece for covering over the head and the body, said fire-protective clothing having an external front pocket defined by an outer flap of fire-proof fabric which is attached to said fire-protective clothing, two opposite openings in said pocket being defined on the chest area by unconnected opposite sides of said outer flap of fire-proof fabric.

4. A fire-protecting suit comprising a fire protective clothing, a fire-proof eye shield, a mouthpiece, a cap-lamp, a gas filter, and a battery power supply, the fire-protective clothing comprising a face mask, wherein the fire-proof eye shield, the cap-lamp and the mouthpiece are directly fastened to the face mask by elastic bands, the gas filter and the battery power supply being mounted to the inside of the fire-protective clothing and respectively connected to the mouthpiece and the cap-lamp by an air hose and an electric wire inside the fire-protective clothing so that the entire fire-protecting suit including the gas filter can be donned rapidly.

5. The fire-protecting suit according to claim 4, wherein the fire-protective clothing is formed of a front part and a back part connected at the shoulder areas having openings on armpit areas thereof, the front part and the back part being releasably connected by loop tapes and hook tapes, the front part having a pocket on a front face thereof.

6. The fire-protecting suit according to claim 4, wherein the fire-protective clothing is made in a single piece for covering over the head and the body, said fire-protective clothing having an external front pocket defined by an outer flap of fire-proof fabric which is attached to said fire-protective clothing, two opposite openings in said pocket being defined on the chest area by unconnected opposite sides of said outer flap of fire-proof fabric.

* * * * *